United States Patent [19]

Bonser et al.

[11] Patent Number: 4,473,383

[45] Date of Patent: Sep. 25, 1984

[54] PRECIPITATOR WITH WEIGHTED RELEASE WIRE

[75] Inventors: Ralph G. Bonser, Livonia; Mitchell D. Charneski, Southfield; Robert V. Collins, Livonia, all of Mich.

[73] Assignee: The Detroit Edison Company, Detroit, Mich.

[21] Appl. No.: 465,270

[22] Filed: Feb. 9, 1983

[51] Int. Cl.[3] ..... B03C 3/04

[52] U.S. Cl. ..... 55/148; 55/151; 248/306

[58] Field of Search ..... 55/136, 146–148, 55/151; 248/339, 306, 341, 294, 364; 24/230.5 R, 230.5 AD, 136, 115 R, 230 TC, 230 AP, 232 G

[56] References Cited

U.S. PATENT DOCUMENTS

| | | | |
|---|---|---|---|
| 992,746 | 5/1911 | Ashdown | 248/306 |
| 2,743,895 | 5/1956 | Tygh | 248/341 |
| 3,354,617 | 11/1967 | Hoisington | 55/151 |

*Primary Examiner*—Bernard Nozick

*Attorney, Agent, or Firm*—Barnes, Kisselle, Raisch, Choate, Whittemore & Hulbert

[57] ABSTRACT

A precipitator comprising a multiplicity of vertical wires suspended from their top ends and having weights connected to their bottom ends, and means responsive to the weight reduction when a wire fails to release the top ends of the wire to provide for removal of the entire portion of the wire above the wire failure point from the precipitator by gravity.

4 Claims, 5 Drawing Figures

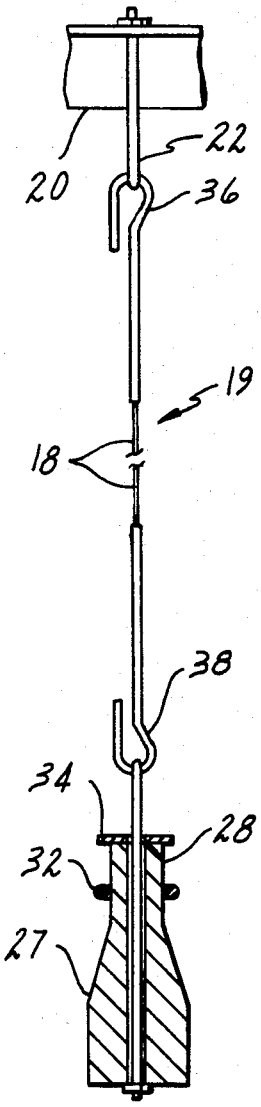
FIG. 2
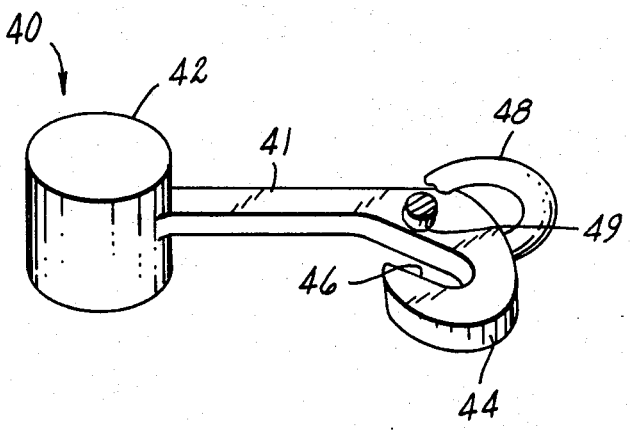
FIG. 3
FIG. 4
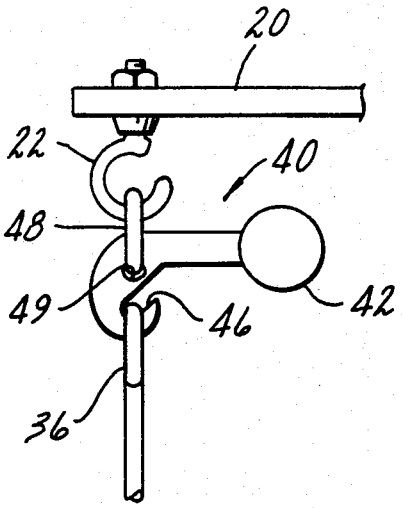
FIG. 5
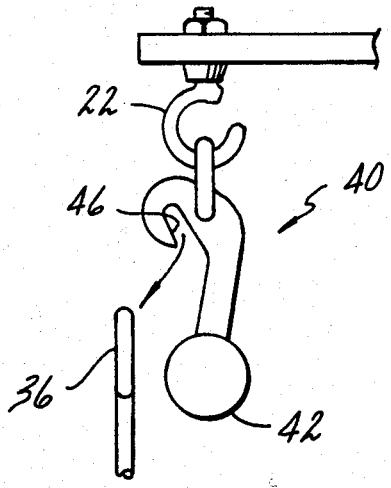

PRECIPITATOR WITH WEIGHTED RELEASE WIRE

BACKGROUND OF THE INVENTION

In coal burning boilers of the type used in steam production for energizing electrical generating systems, it is a requirement that flyash be removed from the gas to reduce atmosphere contamination to a controlled minimum.

This is accomplished in part by the provision, between the boiler outlet and the stack, of a precipitator, whose function is to collect flyash from the exhaust and drop it into hoppers for subsequent disposal.

As commonly used today, these precipitators comprise hundreds of vertical, closely spaced wires, suspended from energized bars which maintain the wires at a high d-c voltage (ca 50000 v). The individual wires have laterally restrained weights at their lower ends to maintain them under tension in separated vertical relationship.

In a commercial installation to which the improvement of the present invention is applied, the weights attached to the lower ends of the individual wires are of bottle shape with reduced necks at their tops. Stop washers are applied to the tops of the reduced necks, and extend radially beyond the necks. Eyebolt guides for each weight provides a ring surrounding the neck through which the washer cannot pass. Accordingly, when a wire fails, the weight is prevented from falling into the hopper.

In practice the wires are about 30 feet long, one hundred mils (0.100") in diameter, with foot long ⅜" diameter rods at both ends, formed to hook shape to suspend the wire from an energized support and to suspend the weight at the bottom of the wire. Weights of approximately 16 pounds are used. The wires are arranged in rows between grounded vertical plate which define passages between adjacent plates for flow of products of combustion.

The basic problem with these precipitators has been that broken wires within a section between adjacent plates cause the plates to be short circuited, and requires that the shorted section must be de-energized. The loss of each section reduces collection efficiency, necessitating reducing the load to stay within stack emission limits. Eventually enough sections are shut down to force an outage for maintenance (removal of shorted wires and replacement thereof).

Wire failure cannot be avoided and may be due to corrosion, erosion, arcing or fatigue.

In accordance with the present invention, an arrangement is provided which will cause automatic removal of both portions of a failed wire, so that each section may stay in operation so long as enough wires remain in service to maintain stack emission within required limits.

Specifically, this is accomplished by providing each wire with suspension means which is maintained in operation by the weight of the wire and its attached weight. A simple embodiment of the invention is one in which a weighted pivotable support is employed, including a hook movable to release position when the load of the wire and its weight is removed.

BRIEF DESCRIPTION OF THE DRAWINGS

FIG. 2 is an elevation partly in section, of an individual charge wire and weight.

FIG. 3 is a perspective view of a simple form of a self-releasing wire support.

FIG. 4 is a fragmentary elevation showing the precipitator provided with a self-releasing wire support.

FIG. 5 is a like view, showing the support in release position.

DETAILED DESCRIPTION

Figure 1:
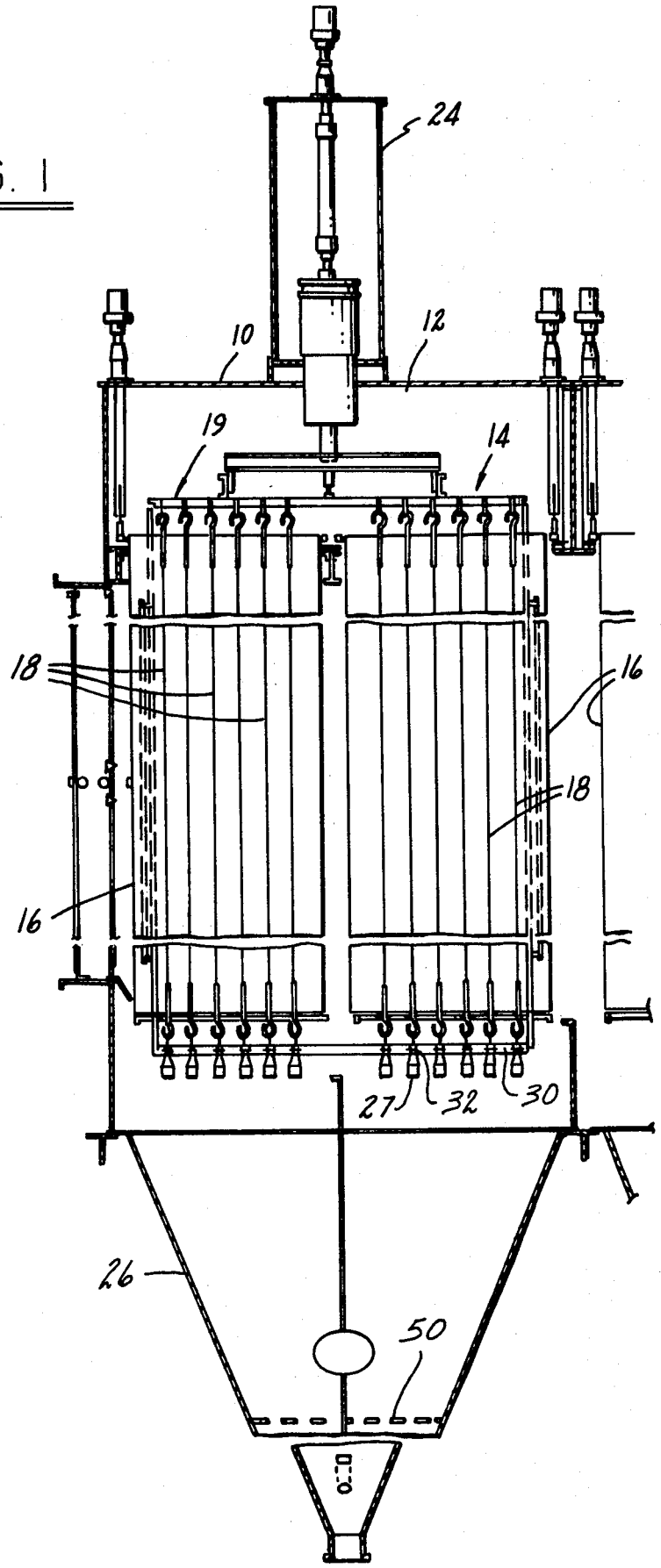
FIG. 1 is a simplified elevation of a known precipitator.

Referring now to the drawings, FIG. 1 shows diagrammatic elevational sectional view of a precipitator section.

The precipitator installation comprises a plurality of sections interconnected to provide the required exposure of the furnace gases to a multiplicity of vertically disposed collector wires which have a negative d.c. charge of many thousands of volts.

FIG. 1 is a diagrammatic representation of a horizontal duct having an upper wall 10, and side walls, one of which is seen at 12. The charged wire support section 14 is one of several disposed in series to provide flow of furnace gases from left to right as indicated by the arrow. In practice, from three to seven sections may be connected in series, and the potential of the charged wires varies from section to section. The wires of first section of the series is at a relatively lower potential, because of the relatively heavy flyash content. The potential is increased from section to section, the highest negative potential being provided on the wires of the final section.

Each section comprises a plurality of flat vertical parallel plates 16 spaced apart to provide narrow passages therebetween for flow of furnace gases. The wires 18 extend vertically in these passages from top to bottom thereof in position for the wires 18 to be contacted by the products of combustion flowing through these passages.

At the top of each section 14 there is provided a wire support frame 19 which comprises a multiplicity of bars 20 as seen in FIG. 2, each of which is provided with a plurality of individual wire suspension hooks 22. In the section 14 illustrated in FIG. 1, it will be observed that twelve wires 18 are provided in a row in the passage between each adjacent pairs of plates 16, and the section may comprise twenty five rows of wires, for a total of three hundred wires to a section. In total, thousands of wires may be in each precipitator to collect flyash.

Each section such as 14 is provided with a rapper assembly 24 which is arranged to impact the frame 19 to jar the accumulated flyash loose from the wires 18. A hopper 26 is provided beneath each section to collect the flyash for subsequent disposal.

In the past, each wire 18 has been provided at its lower end with a weight 27 which is of bottle shape with a reduced neck 28 at its upper end. The precipitator comprises a lower frame 30 composed of bars provided with eyebolts 32 which have rings as best seen in FIG. 2 which encircle the necks 28 of the weights. Stop washers 34 have been provided on the weights, to prevent the weight from falling into the hopper 26.

The eyebolt restrains the lower end of each wire 18 from lateral movement, and the weights 27 keep the wires vertical. When a wire fails, however, the top of the broken wire is held by the top hook and can swing freely as it is impacted by the gas flow in the passage.

This results in the basic problem which is solved by the precipitators disclosed herein. In the past these broken wires, or parts of them, remained in the passage and caused shorts to the adjacent plates within a section. This required de-energization of the section. The loss of the section reduces collection efficiency necessitating reducing the load to stay within stack emission limits. Eventually, enough sections are shut down to force an outage for maintenance (removal of shorted wires, weights, and wire parts), and replacement with new wires and weights.

Wire failure is due to corrosion, erosion, arcing or fatigue.

In present precipitators, the individual wires 18 may be about thirty feet long and one hundred mils in diameter. Each wire is provided with a top hook 36 and a bottom hook 38, formed of ⅜" diameter rod. The weights 27 are about sixteen pounds.

The precipitator as so far described is in widespread use, and is available from a division of American Standard Corporation.

The improved precipitator disclosed herein is characterized by the capability of disposing of some or all portions of wires which have failed in use.

This is accomplished by the provision of self-releasing suspension means for individual wires which is effective, in response to a reduction in weight to disengage the hook at the top of the wire.

A simple device for providing the self release feature is illustrated in FIGS. 3–5 at 40. The device comprises an elongated shank 41 having at one end thereof counterweight 42, and having at its other end a hook 44 which provides an open or unrestricted slot 46. As illustrated, a ring or closed link 48 is attached to the end of the shank 41 remote from the weight.

In normal use as shown in FIG. 4, the ring is engaged in the hook 22 carried by the wire support frame bar 20, and the device 40 is retained in this position by the weight 27 when the wire assembly is suspended from the release device 40. However, when the wire 18 fails for any reason, weight 27 is disconnected from the release device 40, and its counterweight 42 causes it to swing to the release position shown in FIG. 5.

The ring or link 48 extends through a tear shaped opening 49 in the device, the smaller end of which is dimensioned to fit closely with the ring or link 46 when the structure is in the operative position of FIG. 4.

In the improved precipitator, the weight 27 is located and supported against lateral movement by guide means which may in fact be the rings of eyebolts 32 as heretofore described. However, it is a feature of the present invention that the weights and lower end of broken wires are dropped into the hopper 26. Accordingly, the stop washers 34 are omitted, and the weight drops onto the grate 50 in the hopper, drawing the lower end of the broken wire with it.

At the same time the upper end portion of the wire assembly 19, including the top hook or loop 36, drops out of the slot 46 of the hook 44 as shown in FIG. 5. These drop to the open bottom of the passage between the associated plates 16 and fall onto the hopper grate 50.

Since the wire assemblies exceed thirty feet in length, it is desirable for the hopper 26 to have a sufficient depth to accommodate it, thus avoiding the possibility of the wire end being shorted to ground.

However, even if the depth of hopper cannot accommodate the longest wire segment possible, the precipitator can still use the present self-releasing feature effectively. In this case a procedure is available in which grounded hotsticks can be used to retrieve the broken wires through the hopper doors. This can be done with the rest of the precipitator energized. Once the grounded wire is retrieved, the section can be buttoned-up and re-energized, restoring the precipitator to substantially full efficiency.

As illustrated, the release device is provided with a ring or link 48 by which it is suspended from the upper beam hook 22. This causes the long axis of the release device, (its shank 41) to align itself with the beam 20 and with the direction of flow of the furnace gases, which minimizes the possibility of a false trip by plant personnel during maintenance. Similar results are obtained if the beam hooks 22 are oriented 90° to the beam axis, in which case the links or rings 48 are omitted.

When the present invention is practiced by a retro-fit to an existing precipitator as illustrated in FIGS. 1 and 2, the stop washers 34 are removed from weight 27 to permit the weight and attached wire segment to drop through the ring of eyebolt 32 into the hopper.

Secondly, the top hook 36 is closed to form a loop and avoid the possibility of snagging in falling.

Finally, beam hooks 22 may be aligned at right angles with the beams 20, and the use of links or rings 48 becomes unnecessary.

While a particular weight-responsive, self-releasing connection between the wire assembly 19 and the electrically energized bar 20 has been described, the invention in its broader aspect does not of course depend on the use of the specific connection. Obviously, the support element may be spring urged to release position and restrained from such movement by a minimum weight.

We claim:

1. A precipitator for removing flyash from the products of combustion emanating from a burner for a steam generator comprising a horizontal duct for leading gases from a combustion chamber to a stack, suspension means for suspending a multiplicity of vertically disposed laterally spaced wire assemblies comprising electrically energized wires in position to extend across the stream of combustion products, an individual weight connected to the lower end of each wire assembly, individual weight-responsive releasable connectors interposed between the upper end of each wire assembly and said suspension means for releasing the upper portion of the wire assembly, a hopper below said duct for receiving flyash accumulated by said precipitator, guide and locating means associated with the lower ends of said wire assemblies including means for locating the lower ends of said wire assemblies in position to retain the wires of said assemblies in parallel, spaced relation, and for guiding the lower end portion of a wire assembly in which the wire has broken as it drops clear of said duct into said hopper, each of said weight-responsive connectors being effective to suspend a single wire assembly and the weight attached to the lower end thereof and to release the upper portion of the wire assembly when relieved of the weight by breaking of the wire.

2. A precipitator as defined in claim 1, in which the hopper has a depth sufficient to receive the entire lower portion of a wire assembly and its attached weight.

3. A precipitator as defined in claim 1, said weight-responsive connector comprising a hook, said wire assembly at its upper end having a completely closed loop engaged by said hook, so that upon release its closed loop cannot catch on adjacent wires, wire guides.

4. A precipitator as defined in claim 1, in which the hopper has a horizontal grate therein to retain the wire weights and broken wire portions therein while providing for passage of flyash therethrough, said grate being positioned at a distance below the lower ends of suspended wires such that portions of broken wires may remain in position to contact unbroken, electrically charged wires, and hopper having access means to provide for removal of broken wire portions by a hot stick.

* * * * *